US010022767B2

(12) United States Patent
Kang et al.

(10) Patent No.: US 10,022,767 B2
(45) Date of Patent: Jul. 17, 2018

(54) MOLD DEVICE FOR HOT STAMPING

(71) Applicant: Kia Motors Corporation, Seoul (KR)

(72) Inventors: Jae Bum Kang, Gyeonggi-do (KR); Tae Wan Kim, Chungcheongnam-do (KR)

(73) Assignee: Kia Motors Corporation, Seoul (KR)

( * ) Notice: Subject to any disclaimer, the term of this patent is extended or adjusted under 35 U.S.C. 154(b) by 364 days.

(21) Appl. No.: 14/825,658

(22) Filed: Aug. 13, 2015

(65) Prior Publication Data

US 2016/0318086 A1 Nov. 3, 2016

(30) Foreign Application Priority Data

Apr. 29, 2015 (KR) ..... 10-2015-0060561

(51) Int. Cl.
*B21D 22/02* (2006.01)
*B21D 37/04* (2006.01)
*B21D 37/16* (2006.01)

(52) U.S. Cl.
CPC ..... *B21D 22/022* (2013.01); *B21D 37/04* (2013.01); *B21D 37/16* (2013.01)

(58) Field of Classification Search
CPC .... B21D 22/022; B21D 37/16; B21D 22/208; B21D 22/02; B21D 37/04
See application file for complete search history.

(56) References Cited

U.S. PATENT DOCUMENTS

2014/0260493 A1* 9/2014 Yoon ..... B21D 22/022 72/342.5
2015/0336151 A1* 11/2015 Frost ..... B21D 22/022 72/352

FOREIGN PATENT DOCUMENTS

| | | | | |
|---|---|---|---|---|
| JP | 2010-194589 | A | | 9/2010 |
| KR | 10-2011-0075732 | A | | 7/2011 |
| KR | 2012-0016777 | A | | 2/2012 |
| KR | 20120016777 | A | * | 2/2012 |
| KR | 10-2013-0115829 | A | | 10/2013 |
| KR | 2014-0106964 | A | | 9/2014 |
| KR | 20140106964 | A | * | 9/2014 |
| KR | 10-1461887 | B1 | | 11/2014 |

OTHER PUBLICATIONS

Machine translation document publication 10-2014-0106964 from KIPO corresponds to KR 20140106964 A to Jang Jeong Hwan.*
Machine translation document publication 10-2014-0106964 from KIPO corresponds to KR 20120016777 A to Kim Yong Seok.*

* cited by examiner

*Primary Examiner* — Peter DungBa Vo
*Assistant Examiner* — John S Lowe
(74) *Attorney, Agent, or Firm* — Mintz Levin Cohn Ferris Glovsky and Popeo, P.C.; Peter F. Corless

(57) ABSTRACT

The present invention relates to a mold device for hot stamping, and includes: a hot stamping mold that molds an ultra-high strength steel plate and has a softening part; and a block heater part that is inserted into a lower portion of the softening part of the hot stamping mold to soften the ultra-high strength steel plate, in order to maintain a uniform temperature distribution of the softening part of the hot stamping mold and improve the temperature management and the maintenance performance of the softening part by providing a segmented structure for inserting the block heater part into the softening part of the hot stamping mold.

10 Claims, 6 Drawing Sheets

MOLD DEVICE FOR HOT STAMPING

CROSS-REFERENCE TO RELATED APPLICATION

This application claims under 35 U.S.C. § 119(a) the benefit of Korean Patent Application No. 10-2015-0060561, filed on Apr. 29, 2015 in the Korean Intellectual Property Office, the entire contents of which are incorporated herein by reference.

BACKGROUND (a) Technical Field

The present invention relates to a mold device for hot stamping, and more particularly, to a mold device for hot stamping capable of improving convenience of preheating and temperature management, by inserting a block heater having a coil structure into a lower portion of a partial softening hot stamping mold to form a heater distribution at a uniform position of a steel plate so as to keep a uniform mold temperature.

(b) Description of the Related Art

Generally, an ultra-high strength steel plate has been used to reduce the weight of a vehicle body and improve collision performance.

In this case, a technology of molding the ultra-high strength steel plate (tensile strength of 1400 MPa or more) has used a hot stamping mold.

However, in the case of a center filler outer part, the steel plate is brittle at the time of vehicle collision, and thus a fracture of the steel plate may result. Therefore, it is difficult to ensure safety of occupants of the vehicle.

To address the above problem, the related art proposes to heat a mold and then mold the mold by inserting a cartridge heater into the mold to allow a steel plate to be partially softened to a low strength (tensile strength ranging from 760 to 1100 MPa). However, the cartridge heater cannot but be inserted into a side portion of the mold, and therefore a temperature of the cartridge heater is non-uniform, such that the strength and dimension of molded panel products may be unstable.

Further, the related art includes a method of making a softening part shaped mold into an integrated type, in which a heating volume may be excessive. Therefore, it is difficult to control preheating and temperature, and deformation of the shaped mold after thermal expansion may be excessive due to the integrated type.

SUMMARY

An aspect of the present invention provides a mold device for hot stamping capable of improving convenience of preheating and temperature management, by inserting a block heater having a coil structure into a lower portion of a partial softening hot stamping mold to form a heater distribution at a uniform position of a steel plate so as to keep a uniform mold temperature.

According to an exemplary embodiment of the present invention, a mold device for hot stamping includes a hot stamping mold configured to mold a steel plate, the hot stamping mold including a softening part provided at a portion thereof; and a block heater part configured to be inserted into a lower portion of the softening part of the hot stamping mold to soften the steel plate.

The block heater part may include: a plurality of block molds configured to be vertically inserted into the softening part of the hot stamping mold; and a plurality of block heaters configured to be inserted into the block molds to uniformly heat the block molds and the softening part of the hot stamping mold.

A lower portion of the block molds may be provided with a plate which fixes the block heater.

A lower portion of the plate may be provided with an insulating base between the block molds and the softening part of the hot stamping mold.

The block molds may be segmented into five block molds to correspond to a shape of the softening part of the hot stamping mold so as to minimize a deformation due to thermal expansion.

The block heaters may be formed in a protrusion shape having a predetermined height, and an outer circumferential surface of each of the block heaters may be provided with a coil to generate heat.

A coil of each of the block heaters may be supplied with power from the outside to generate heat.

A heating temperature of the block heater parts applied to the softening part of the hot stamping mold may be set to be about 420° C.

A high strength part except the softening part of the hot stamping mold may be provided with a cooling water passage of which the temperature is set to be about 20° C.

According to another exemplary embodiment of the present invention, a mold device for hot stamping includes a hot stamping mold configured to mold a steel plate, provided with a high strength part, and including a softening part provided at a portion thereof; and a block heater part configured to include a plurality of block molds vertically inserted into the softening part of the hot stamping mold, and a plurality of block heaters inserted into the block molds to uniformly heat the block mold and the softening part of the hot stamping mold and provided with a coil, a plate, which fixes the block heaters, provided at a lower portion of the block mold, and an insulating base between the block molds and the softening part of the hot stamping mold to soften the steel plate.

BRIEF DESCRIPTION OF THE DRAWINGS

The above and other objects, features and advantages of the present invention will be more apparent from the following detailed description taken in conjunction with the accompanying drawings.

DETAILED DESCRIPTION

Figure 1:
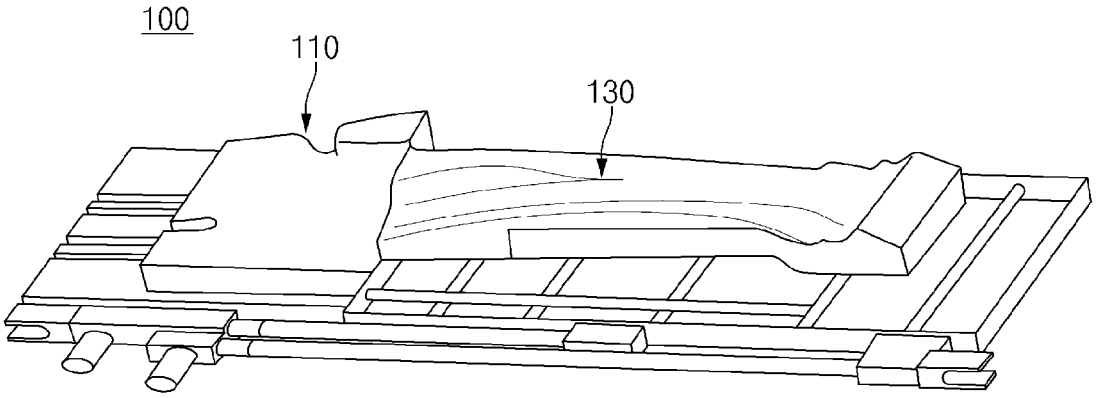
FIG. 1 is a diagram illustrating a mold device for hot stamping according to an exemplary embodiment of the present invention.

Exemplary embodiments of the present invention will be described in detail with reference to the accompanying drawings.

It is understood that the term "vehicle" or "vehicular" or other similar tam as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the tam "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof.

Further, the control logic of the present invention may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

As illustrated in FIGS. 1 to 5 and 6(*a*)-(*d*), a mold device for hot stamping according to an exemplary embodiment of the present invention includes a hot stamping mold 100 provided with a softening part 110 and a block heater part 120 inserted into the softening part 110 of the hot stamping mold 100.

Figure 2:
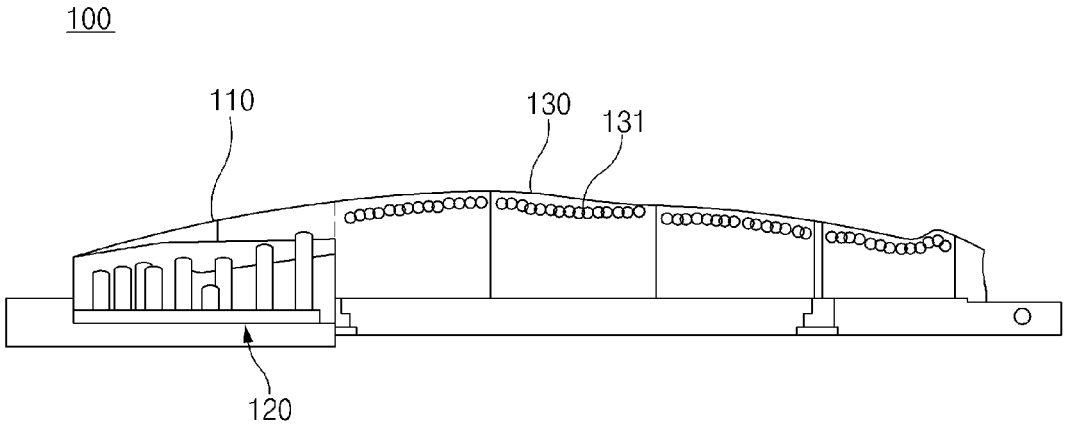
FIG. 2 is a cross-sectional side view of the mold device of FIG. 1.

As illustrated in FIGS. 1 and 2, the hot stamping mold 100 molds an ultra-high strength steel plate, and a portion thereof is provided with the softening part 110.

In this case, a remaining portion, except the softening part 110, of the hot stamping mold 100 is formed as a high strength part 130.

The block heater part 120 may be inserted into a lower portion of the softening part 110 of the hot stamping mold 100 to soften a portion of the ultra-high strength steel plate.

Figure 4:
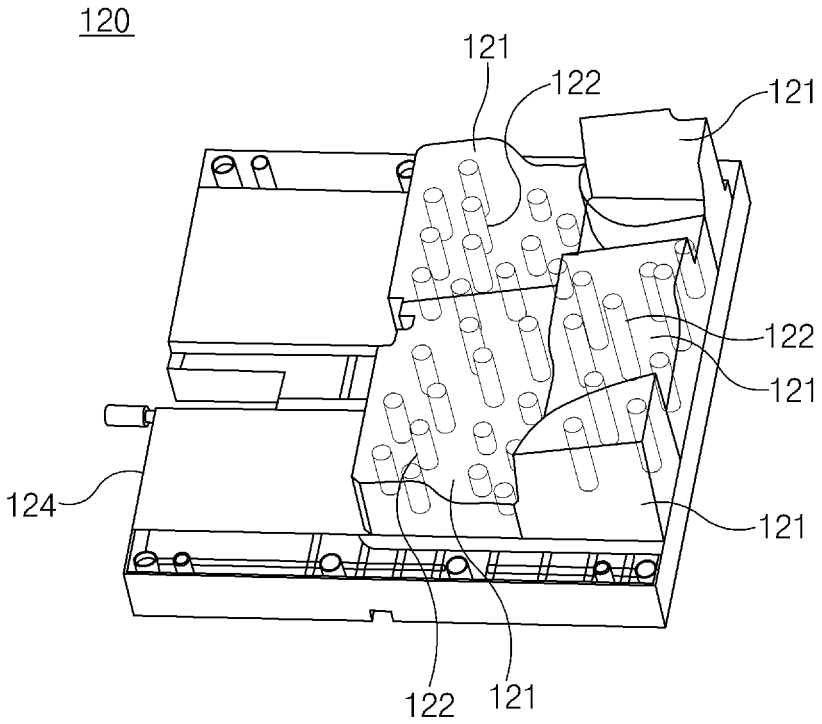
FIG. 4 is a diagram illustrating a block heater part of the mold device for hot stamping according to the exemplary embodiment of the present disclosure.

As illustrated in FIGS. 2 and 4, the block heater part 120 includes a plurality of block molds 121 vertically inserted into the softening part 110 of the hot stamping mold 100, and a plurality of block heaters 122 inserted into the block mold 121, to uniformly heat the block mold 121 and the softening part 110 of the hot stamping mold 100.

As such, the present invention vertically inserts the block heater part 120 into the softening part 110 of the hot stamping mold 100 to constantly keep a distance from a shaped part, and thus may more uniformly keep the temperature of the hot stamping mold 100 than the related art.

Figure 5:
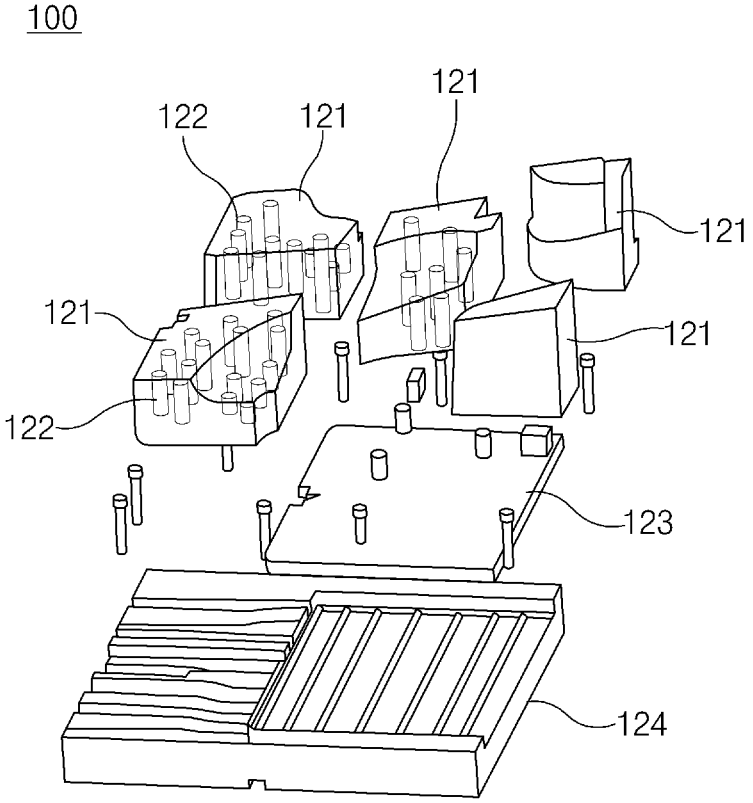
FIG. 5 is an exploded perspective view illustrating the block heater part of FIG. 4.
Figure 6A:
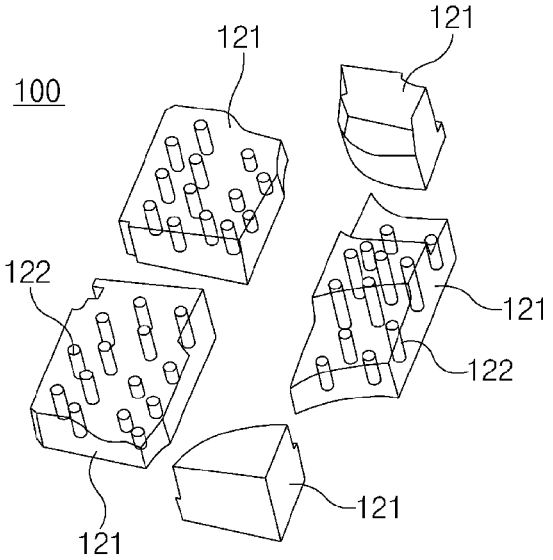
FIGS. 6(*a*)-(*d*) are diagrams illustrating a block mold, a block heater of a block heater part, a plate of the block heater part, and a base of the block heater part, respectively, of the mold device for hot stamping according to the exemplary embodiment of the present invention.
Figure 6B:
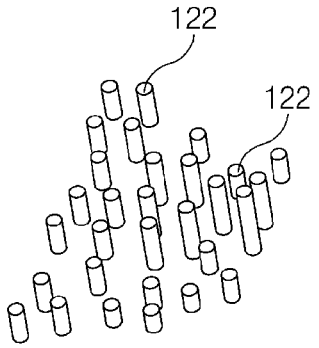
Figure 6C:
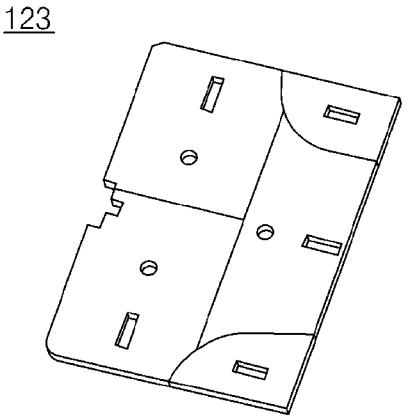
Figure 6D:
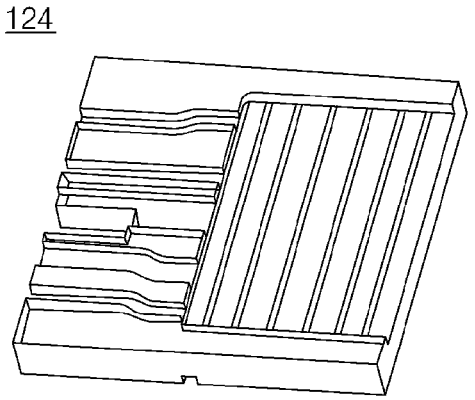

As illustrated in FIGS. 5 and 6, the lower portion of the block molds 121 is provided with a plate 123 which fixes the block heaters 122, and thus the block heater 122 may be fixed to the block molds 121, and a lower portion of the plate 123 is provided with a base 124 (i.e., an insulating base) between the block molds 121 and the softening part 110 of the hot stamping mold 100, thereby minimizing a heat loss of the hot stamping mold 100.

Meanwhile, a hydraulic press facility for hot stamping molding can be utilized to press the mold, for example, at a load of 700 tons for 14 seconds. In this case, the mold may be cracked due to the load applied to the mold, and therefore the mold must be robustly designed. According to the exemplary embodiment of the present invention, the block mold 121 and the mold of the softening part 110 in the block heater part 120 are made of the same material DAC-P and thus are assembled to be vertically inserted, such that the mold performing the vertical molding is provided with a load support structure, thereby forming the mold in the robust structure.

Further, the related art needs to replace a heater according to the lifespan of the heater. However, according to the exemplary embodiment of the present invention, there is no need to replace the heater due to a structure of a coil 125 and the vertical insertion assembling may be made even at the time of the occurrence of failure, such that the hot stamping mold 100 and the block heater 122 may be modularized to be easily disassembled and assembled.

In this case, the block molds 121 are segmented into five block molds to correspond to the shape of the softening part 110 of the hot stamping mold 100 and thus the size thereof is reduced, such that a deformation due to thermal expansion may be minimized.

Further, the block heaters 122 each are formed in a protrusion shape having a predetermined height, and an outer circumferential surface thereof is provided with the coil 125, thereby generating heat from the block heater 122.

Figure 3:
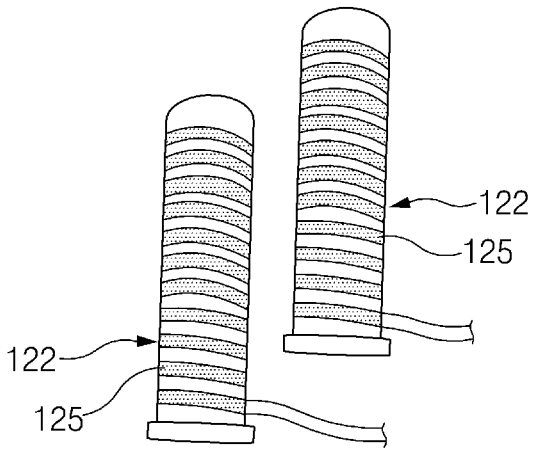
FIG. 3 is a diagram illustrating a block heater of the mold device for hot stamping according to the exemplary embodiment of the present disclosure.

In this case, as illustrated in FIGS. 3 and 4, the coil 125 of the block heater 122 is connected to the outside to be supplied with power from the outside, thereby generating heat.

Meanwhile, the heating temperature of the block heater part 120 applied to the softening part 110 of the hot stamping mold 100 according to the exemplary embodiment of the present invention is set to be 420° C. and the high strength part 130 is set to be 20° C. through a cooling water passage 131, thereby forming a high-strength steel plate and softening a portion thereof at low strength.

As described above, the present invention includes the hot stamping mold 100 configured to form the ultra-high strength steel plate, be provided with the high strength part 130, and including the softening part 110 provided at a portion thereof and the block heater part 120 configured to include the plurality of block molds 121 vertically inserted into the softening part 110 of the hot stamping mold 100, the plurality of block heaters 122 inserted into the block mold 121 to uniformly heat the block mold 121 and the softening part 110 of the hot stamping mold 100 and provided with the coil 125, the plate 123, which fixes the block heaters 122, provided at the lower portion of the block molds 121, and the base 124 insulating between the block molds 121 and the softening part 110 of the hot stamping mold to soften the ultra-high strength steel plate, to thereby appropriately control the physical parameters for the steel plate and implement the stabilization of product quality by keeping the temperature distribution of the softening part 110 of the hot stamping mold 100 uniform, improve the temperature management and the maintenance performance of the softening part 110 by making the block heater parts 120 inserted into the softening part 110 of the hot stamping mold 100 into the segmented structure, and improve the convenience of work by modularizing the hot stamping mold 100 and the block heater 122 to be easily disassembled and assembled.

Hereinabove, although the present invention has been described with reference to exemplary embodiments and the accompanying drawings, the present invention is not limited thereto, but may be variously modified and altered by those skilled in the art to which the present invention pertains without departing from the spirit and scope of the present invention claimed in the following claims.

What is claimed is:

1. A mold device for hot stamping, comprising:

a hot stamping mold configured to mold a steel plate, the hot stamping mold having a softening part provided at a portion thereof; and a block heater part configured to be connected to a lower portion of the softening part of the hot stamping mold to soften the steel plate, wherein the block heater part includes at least a block mold segmented into five block molds; and a plurality of block heaters configured to be inserted into the block molds to uniformly heat the block molds and the softening part of the hot stamping mold.

2. The mold device for hot stamping according to claim 1, wherein the block heater part includes:

a plurality of block molds configured to be vertically assembled to the softening part of the hot stamping mold.

3. The mold device for hot stamping according to claim 2, further comprising a plate arranged at a lower portion of the block molds so as to fix the plurality of block heaters.

4. The mold device for hot stamping according to claim 3, wherein a lower portion of the plate is provided with an insulating base to minimize heat loss between the block molds and the softening part of the hot stamping mold.

5. The mold device for hot stamping according to claim 2, wherein the plurality of block molds is five block molds that correspond to a shape of the softening part of the hot stamping mold so as to minimize a deformation due to thermal expansion.

6. The mold device for hot stamping according to claim 2, wherein the block heaters are formed in a protrusion shape having a predetermined height, and an outer circumferential surface of each of the block heaters is provided with a coil to generate heat.

7. The mold device for hot stamping according to claim 6, wherein the coil of each of the block heaters is supplied with power from outside to generate heat.

8. The mold device for hot stamping according to claim 1, wherein a heating temperature of the block heater part applied to the softening part of the hot stamping mold is set to be about 420° C.

9. The mold device for hot stamping according to claim 8, wherein a high strength part except the softening part of the hot stamping mold is provided with a cooling water passage of which a temperature is set to be about 20° C.

10. A mold device for hot stamping, comprising:

a hot stamping mold configured to mold a steel plate, provided with a high strength part, and including a softening part provided at a portion thereof; and a block heater part configured to include a plurality of block molds vertically assembled to the softening part of the hot stamping mold, and a plurality of block heaters inserted into the block molds to uniformly heat the block molds and the softening part of the hot stamping mold and provided with a coil, a plate, which fixes the block heaters, provided at a lower portion of the block molds, and an insulating base to minimize heat loss between the block molds and the softening part of the hot stamping mold to soften the steel plate, wherein the block heater part includes at least a block mold segmented into five block molds; and a plurality of block heaters configured to be inserted into the block molds to uniformly heat the block molds and the softening part of the hot stamping mold.

* * * * *